US008025535B1

(12) United States Patent
Sun et al.

(10) Patent No.: US 8,025,535 B1
(45) Date of Patent: Sep. 27, 2011

(54) AUDIO SOCKET CONNECTOR AND SWITCH MODULE

(75) Inventors: Dao-Rui Sun, Guang-Dong (CN); Feng Zhu, Guang-Dong (CN); Kuo-Chin Lin, Tu-Cheng (TW)

(73) Assignee: Cheng UEI Precision Industry Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 12/830,276

(22) Filed: Jul. 2, 2010

(51) Int. Cl.
*H01R 24/04* (2006.01)

(52) U.S. Cl. ..... 439/668; 439/188

(58) Field of Classification Search ..... 439/668, 439/669, 188; 200/51.1
See application file for complete search history.

(56) References Cited

U.S. PATENT DOCUMENTS 7,112,099 B2 * 9/2006 Ma ..... 439/668
7,641,483 B2 * 1/2010 Wei et al. ..... 439/131
7,785,119 B1 * 8/2010 Chiang ..... 439/188
7,833,032 B1 * 11/2010 Yu ..... 439/188
7,901,251 B1 * 3/2011 Chen ..... 439/668

* cited by examiner

*Primary Examiner* — T C Patel
*Assistant Examiner* — Phuongchi T Nguyen
(74) *Attorney, Agent, or Firm* — Cheng-Ju Chiang

(57) ABSTRACT

A socket connector includes an insulating housing, at least one terminal set and a switch module. The insulating housing defines an inserting hole. The terminal set and the switch module are respectively received in the insulating housing. The switch module includes a fixed terminal, a movable terminal and an insulating guider. The insulating guider is connected to the moveable terminal and electronically insulated from the moveable terminal for preventing signal transmitted by the socket connector from influence. Because the movable terminal is molded with the insulating guider, the strength of the switch module of the audio socket connector will be improved. Since, the audio socket connector has strong structure and high reliability.

17 Claims, 5 Drawing Sheets

AUDIO SOCKET CONNECTOR AND SWITCH MODULE

BACKGROUND OF THE INVENTION

1. Field of the Invention

The present invention relates to a socket connector, more specifically, to an audio socket connector with a switch module having strong structure and high reliability.

2. The Related Art

Nowadays, various connectors are developed for adapting to various electrical devices. The connectors are used for interconnecting various electrical devices and transmitting electrical signal. Especially, an audio socket connector for transmitting audio signal is a necessary component in an electrical with audio function such as a mobile phone, a PDA, a MP3, a MP4, a laptop computer, a desktop computer, etc. Due to the high quality demand of above devices, the audio socket connector with strong structure and high reliability is demand.

A conventional audio socket connector includes an insulating housing, a switch terminal set and a plurality of terminals. The insulating housing includes an inserting hole formed therein and connected outside. The switch terminal set and the terminals are received in the insulating housing. The switch terminal set includes a fixed terminal and a movable terminal. The movable terminal includes a resilient curved arm extending into the inserting hole.

If an audio plug is inserted into the inserting hole of the audio socket connector, the resilient curved arm of the movable terminal can be pressed by the audio plug to connect the fixed terminal for switching on the audio function. If the audio plug is pulled out the inserting hole of the audio socket connector, the resilient curved arm of the movable terminal can be separated from the fixed terminal by resilient force thereof for switching off the audio function.

However, the signal interference will be caused, because the audio plug electronically connects the resilient curved arm of the movable terminal. The signal interference will reduce the quality of the audio function. Moreover, it is inconvenient to manufacture the resilient curved arm of the movable terminal due to audio socket connector with a compact size.

After a long term use, the resilient curved arm of the movable terminal may be easily broken due to the elastic fatigue. Therefore, the audio socket connector has low quality and low reliability.

SUMMARY OF THE INVENTION

An object of the present invention is to provide a socket connector.

According to the invention, the socket connector includes an insulating housing, at least one terminal set and a switch module. The insulating housing defines an inserting hole. The terminal set and the switch module are respectively received in the insulating housing. The switch module includes a fixed terminal, a movable terminal and an insulating guider. The insulating guider is connected to the moveable terminal and electronically insulated from the moveable terminal and the fixed terminal.

Another object of the present invention is to provide an audio socket connector.

According to the invention, the audio socket connector for being inserted an audio plug includes an insulating housing, a plurality of signal terminals and a switch module. The insulating housing defines an inserting hole. The signal terminals and the switch module are respectively received in the insulating housing.

The switch module includes a fixed terminal, a movable terminal and an insulating housing. The insulating guider is connected to the movable terminal and extended into the inserting hole. The audio plug is inserted into the inserting hole and connected to the insulating guider. The audio plug is electronically insulated from the movable terminal via the insulating guider.

A further object of the present invention is to provide a switch module for a socket connector mating with a metal product.

According to the invention, the switch module includes a fixed module, a movable terminal and an insulating housing. The insulating guider is connected to the moveable terminal. The metal product connects to and pushes the insulating guider for driving the movable terminal to move. The metal product is insulated from the movable terminal via the insulating guider.

The insulating guider of the switch module is electronically insulated from the fixed terminal and the movable terminal for preventing an audio function from being influenced if the audio plug is inserted into the audio socket connector. Because the movable terminal is molded with the insulating guider, the strength of the switch module of the audio socket connector will be improved. Since, the audio socket connector has strong structure and high reliability.

BRIEF DESCRIPTION OF THE DRAWINGS

The present invention will be apparent to those skilled in the art by reading the following description of preferred embodiments thereof, with reference to the attached drawings, in which.

DETAILED DESCRIPTION OF THE PREFERRED EMBODIMENT

Figure 1:
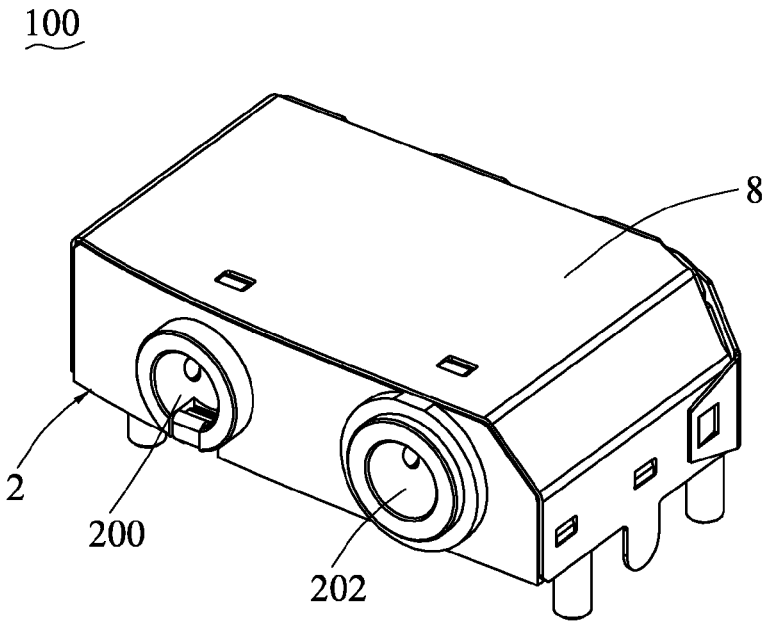
FIG. 1 is a perspective view of a preferred embodiment of an audio socket connector according to the present invention.
Figure 2:
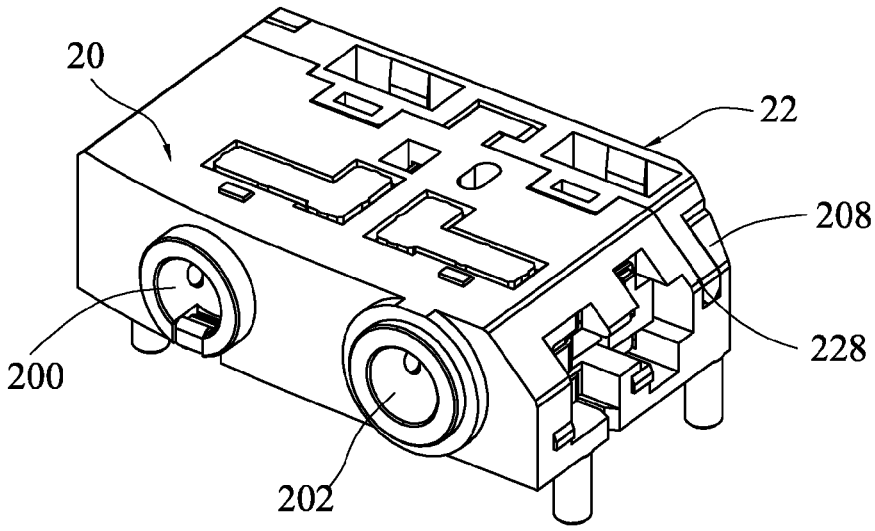
FIG. 2 is a perspective view of the audio socket connector without a metal shield in FIG. 1.
Figure 3:
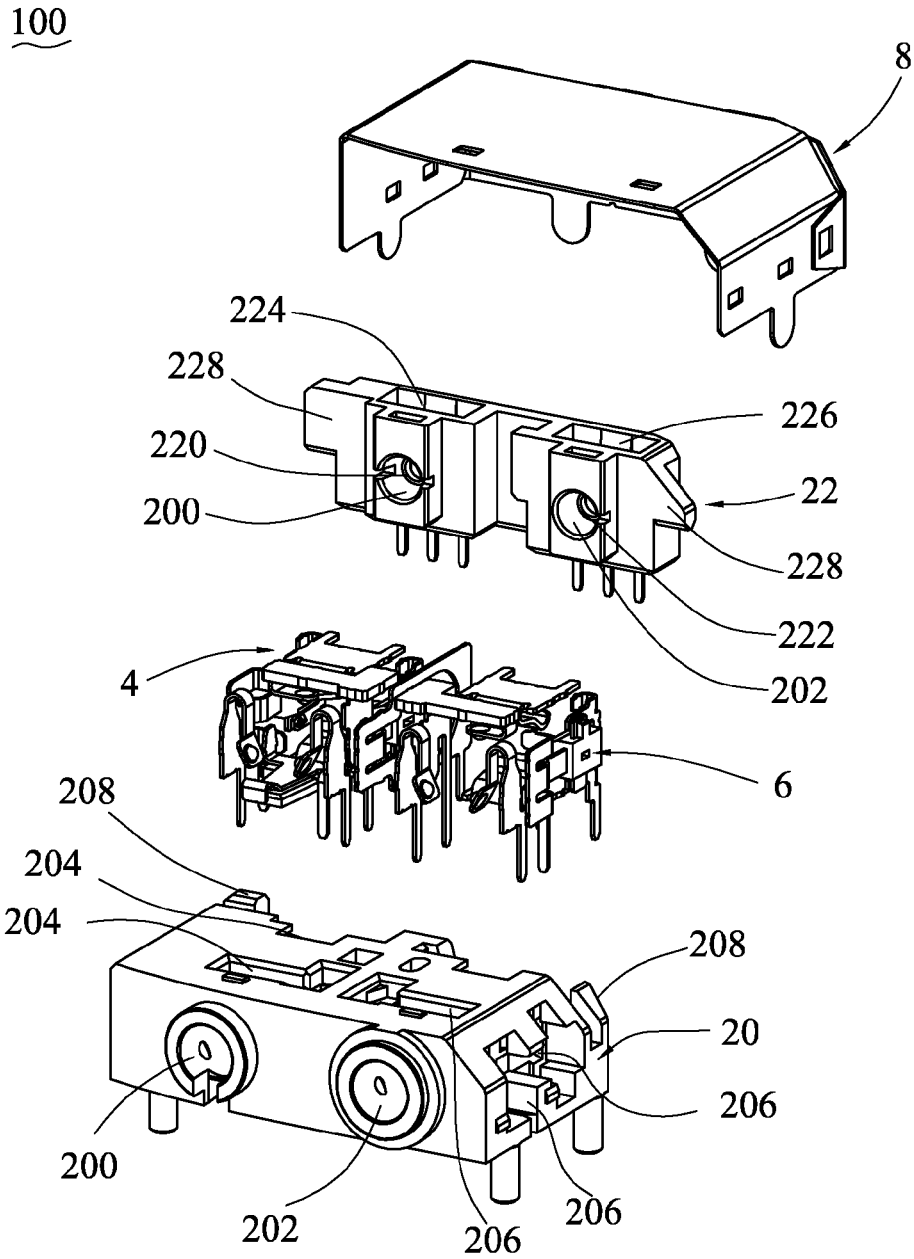
FIG. 3 is an exploded view of the audio socket connector in FIG. 1.

Please refer to FIG. 1 to FIG. 3. A preferred embodiment of a socket connector is an audio socket connector 100. The audio socket connector 100 has an insulating housing 2, a first terminal set 4, a second terminal set 6 and metal shield 8. The first terminal set 4 and the second terminal set 6 are respectively received in the insulating housing 2. The metal shield 8 covers a portion of the insulating housing 2.

The insulating housing 2 has a front housing 20 and a rear housing 22 connected to the front housing 20. The front housing 20 has a first inserting hole 200, a second inserting hole 202, a first groove set 204, a second groove set 206 and a pair of hooks 208.

The first inserting hole 200 and the second inserting hole 202 are respectively penetrated a front surface and a rear surface of the front housing 20 and extended into the rear housing 22. The first groove set 204 is adjacent to and connected to the first inserting hole 200. The second groove set 206 is adjacent to and connected to the second inserting hole 202. The hooks 208 are formed at a rear portion of front housing 20.

The rear housing 22 has a first restricting surface 220, a second restricting surface 222, a first light 224, a second light 226, a pair of ribs 228. The first restricting surface 220 and the second restricting surface 222 are respectively defined in the first inserting hole 200 and the second inserting hole 202 of the rear housing 22 for blocking an audio plug 9.

The first light 224 and the second light 226 are respectively received in the rear housing 22 and connected to the first inserting hole 200 and the second inserting hole 202. Furthermore, the first restricting surface 220 and the second restricting surface 222 can prevent the first light 224 and the second light 226 from being poked by the audio plug 9.

The ribs 228 are laterally protruded from opposite sides of the rear housing 22 respectively for engaging with the hooks 208 of the front housing 20. Since, the front housing 20 and the rear housing 22 are assembled by engagement of the ribs 228 and the hooks 208. Since, the rear housing 22 can retain the first terminal set 4 and the second terminal set 6 inserted in the front housing 20 from the rear surface.

Figure 4:
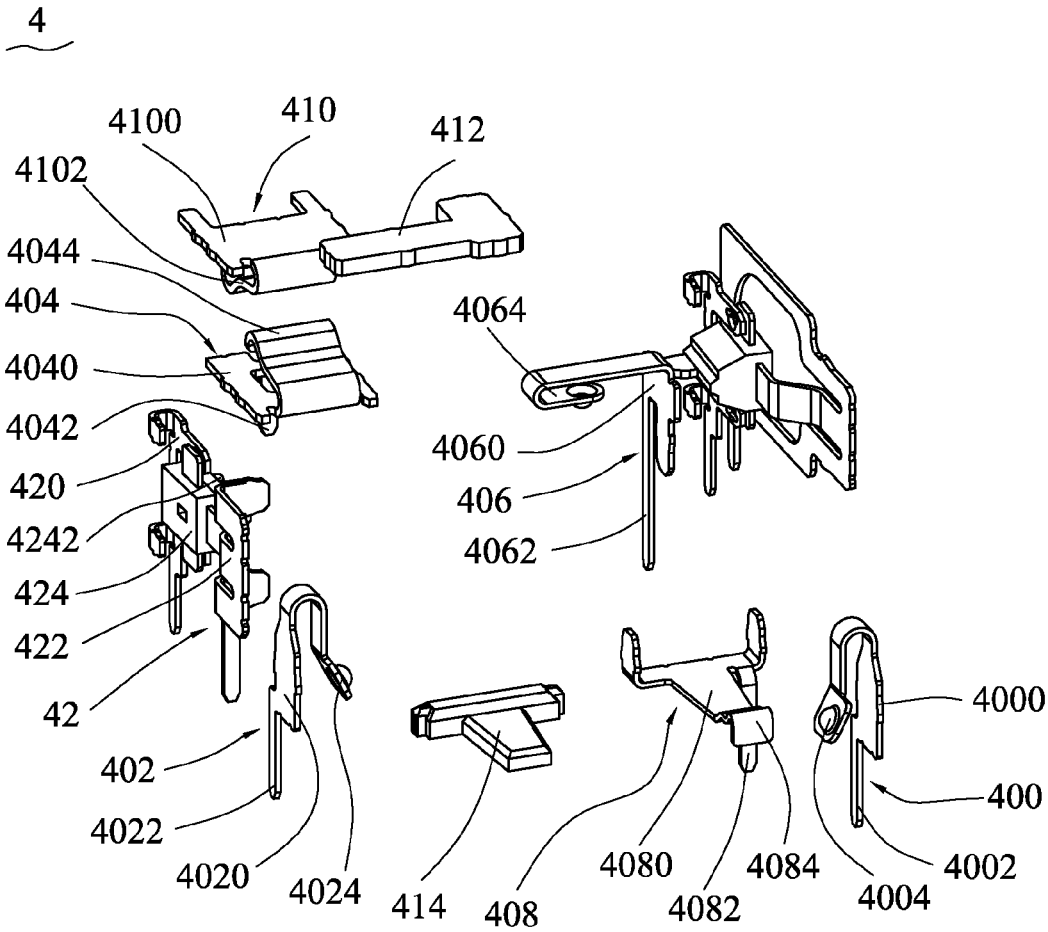
FIG. 4 is an exploded view of a terminal set of the audio socket connector in FIG. 1.

Please refer to FIG. 3 and FIG. 4. The first terminal set 4 has a signal terminal set and a switch module 42. The signal terminal set has a first signal terminal 400, a second signal terminal 402, a third signal terminal 404, a fourth signal terminal 406, a fifth signal terminal 408, a retaining terminal 410, a top cover 412, and a bottom cover 414.

The first signal terminal 400 has a first retained portion 4000, a first soldering leg 4002 extended downward from the first retained portion 4000 and a first curved arm 4004 extending upward from the first retained portion 4000 and bending downward. The second signal terminal 402 has a second retained portion 4020, a second soldering leg 4022 extending downward from the second retained portion 4020 and a second curved arm 4024 extending upward from the second retained portion 4020 and bending downward.

The third signal terminal 404 has a third retained portion 4040, a third soldering leg 4042 bending and extending downward from the third retained portion 4040 and a third curved arm 4044 bending and extending upward from the third retained portion 4040. The fourth signal terminal 406 has a fourth retained portion 4060, a fourth soldering leg 4062 extending downward from the fourth retained portion 4060 and a fourth curved arm 4064 laterally bending and extending from the fourth retained portion 4060.

The fifth signal terminal 408 has a fifth retained portion 4080, a fifth soldering leg 4082 bending and extending downward from the fifth retained portion 4080 and a fifth curved arm 4084 bending and extending upward from the fifth retained portion 4080.

Each retained portion of each signal terminal is received in the corresponding groove of first groove set 204. Each soldering leg of each signal terminal protrudes downward from the front housing 20 for being soldered to a printed circuit board. Each curved arm of each signal terminal extends into the first inserting hole 200.

The retaining terminal 410 is opposite to the third signal terminal 404. The retaining terminal 410 includes a sixth retained portion 4100 and a sixth curved arm 4102 bending and extending downward from the sixth retained portion 4100. The sixth retained portion 4100 is retained in the front housing 20. The sixth curved arm 4102 extends into the first inserting hole 200.

The sixth curved arm 4102 of the retaining terminal 410 and the third curved arm 4044 of the third signal terminal 404 will together clip the audio plug 9 for retaining the audio plug 9 in the first inserting hole 200 if the audio plug 9 is inserted into the first inserting hole 200 of the insulating housing 2. Since, the retaining terminal 410 can improve the retaining force of the audio socket connector 100.

The top cover 412 and the bottom cover 414 are respectively engaged to the front housing 20 for covering the fourth signal terminal 406 and the fifth signal terminal 408. Since, the top cover 412 and the bottom cover 414 can protect the fourth signal terminal 406 and the fifth signal terminal 408 from damage.

Figure 5:
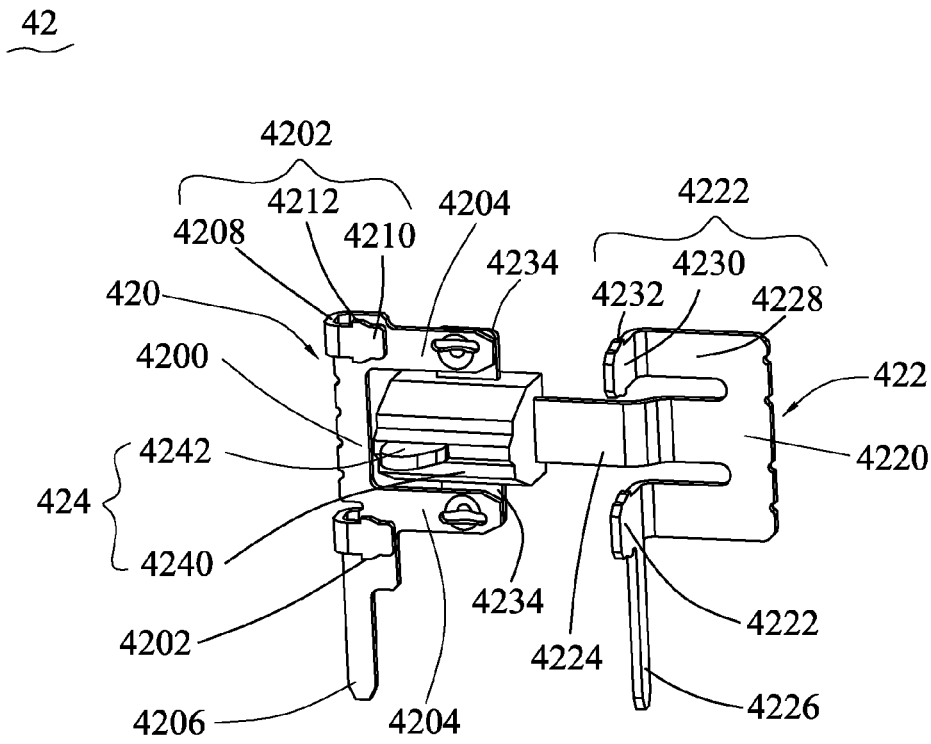
FIG. 5 is a perspective view of a switch module of the audio socket connector in FIG. 4.
Figure 6:
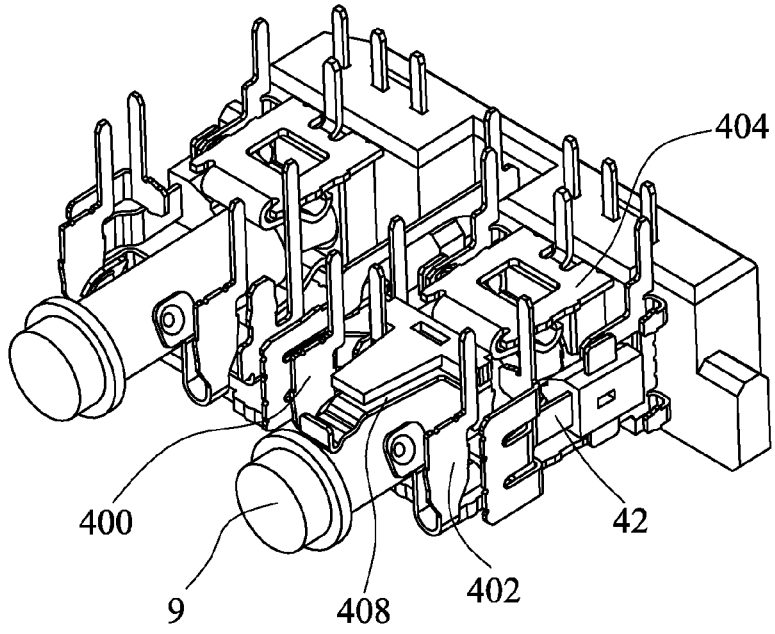
FIG. 6 shows two audio plugs respectively connected to two terminal sets.
Figure 7:
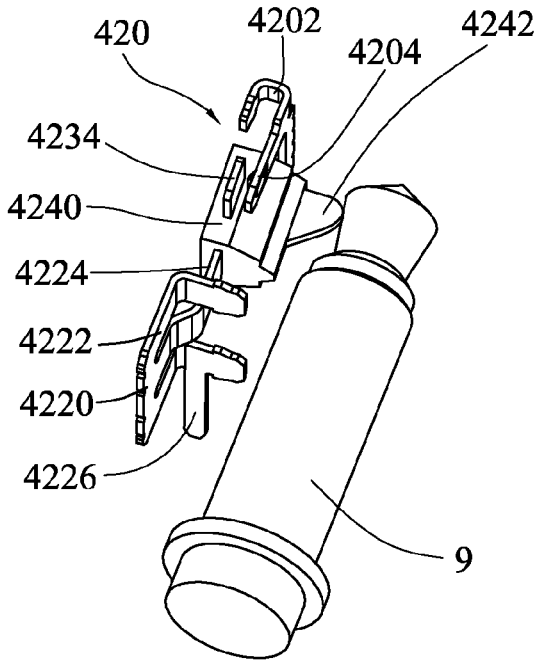
FIG. 7 shows the audio plug connected to the switch module.
Figure 8:
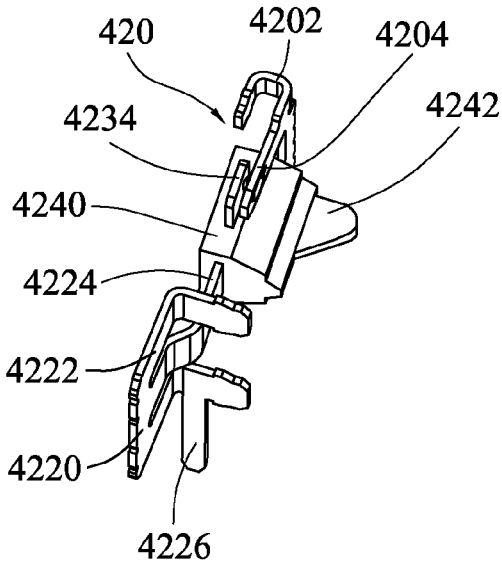
FIG. 8 shows the switch module without connecting the audio plug.

Please refer to FIG. 3 and FIG. 5. The switch module 42 has a fixed terminal 420, a movable terminal 422 and an insulating guider 424. The fixed terminal 420 has a first retained body 4200, a pair of first retained arms 4202, a pair of connecting arms 4204 and a first solder leg 4206.

The first retained body 4200 is formed as a long narrow strip to define opposite end portions. The first retained body 4200 is positioned erect. The first retained arms 4202 are respectively extended from opposite end portions of one edge of the first retained body 4200. Each first retained arm 4202 is perpendicularly extended from the first retained body 4200 to form a first connection portion 4208 and bent to face the first retained body 4200 to form a first retained portion 4210. Opposite edges of the first retained portion 4210 are respectively extended to form a barb 4212. Especially, each first retained arm 4202 is formed as an L-shape.

The connecting arms 4204 are respectively extended from the opposite end portions of the other edge of the first retained body 4200 and toward the movable terminal 422. Each connecting arm 4204 is perpendicular to the first retained body 4200. The connecting arms 4204 and the first retained body 4200 are together to form as a U-shape. The first soldering leg 4206 is extended downward from one end portion of the first retained body 4200.

The movable terminal 422 has a second retained body 4220, a pair of second retained arms 4222, a resilient connecting arm 4224 and a second soldering leg 4226. The second retained body 4220 is formed as a long narrow strip to define opposite end portions. The second retained body 4220 is positioned erect.

The second retained arms 4222 are respectively extended from opposite end portions of one edge of the second retained body 4220. Each second retained arm 4222 is extended toward the fixed terminal 420 to form a second connection portion 4228 and perpendicularly bent to form a second retained portion 4230.

Opposite edges of the second retained portion 4230 are respectively extended to form a barb 4232. Especially, the second retained body 4220 and the connection portions 4228 of the second retained arms 4222 are together formed as a U-shape. Especially, each second retained arm 4222 is formed as an L-shape. The second soldering leg 4226 is extended downward from one edge of one of the second retained portion 4230 of the second retained arm 4222.

The resilient connecting arm 4224 is extended from a central portion of one edge of the second retained body 4220 and toward the fixed terminal 420. Especially, one end portion of the resilient connecting arm 4224 is positioned between the second retained arms 4222 and the other end portion of the resilient connecting arm 4224 is positioned between the first retained arms 4202 of the fixed terminal 420.

The opposite edges of the other portion of the resilient connecting arm 4224 are respectively extend to form a connecting tab 4234. Each connecting tab 4234 of the resilient connecting arm 4224 of the movable terminal 422 is positioned to face corresponding connecting arm 4204 of the fixed terminal 420.

The insulating guider 424 has an insulating block 4240 and a metal guiding piece 4242. The insulating block 4240 wraps the other end portion of the resilient connecting arm 4224 and positioned between the connecting arms 4204 of the fixed terminal 420. Especially, the connecting tabs 4234 of the resilient connecting arm 4224 are respectively protruded from opposite sides of the insulating block 4240.

The metal guiding piece 4242 is molded with the insulating block 4240 and protruded from the insulating block 4240. Especially, the metal guiding piece 4242 is extended into the first inserting hole 200 of the front housing 20. One edge of the metal guiding piece 4242 is positioned to connect the audio plug 9 if the audio plug 9 is inserted into the first inserting hole 200. The metal guiding piece 4242 is electronically insulated from the fixed terminal 420 and the movable terminal 422.

Each of the fixed terminal 420, the movable terminal 422 and the insulating guider 424 is received in the corresponding groove of the first groove set 204. The first soldering leg 4206 of the fixed terminal 420 and the second soldering leg 4226 of the movable terminal 422 are respectively protruded downward from the front housing 20 for being soldered to the printed circuit board.

Please refer to FIG. 3 to FIG. 8. If the audio plug 9 is inserted into the first inserting hole 200 of the insulating housing 2 of the audio socket connector 100, then audio plug 9 will abut against the first curved arm 4004 of the first signal terminal 400, the second curved arm 4024 of the second signal terminal 402, the third curved arm 4044 of the third signal terminal 404, the fourth curved arm 4064 of the fourth signal terminal 406 and the fifth curved arm 4084 of the fifth signal terminal 408.

Meanwhile, the audio plug 9 pushes the metal guiding piece 4242 of the insulating guider 424. Each connecting tab 4234 of the resilient connecting arm 4224 of the movable terminal 422 is brought to separate from the corresponding connecting arm 4204 of the fixed terminal 420 for switching on the audio function.

If the audio plug 9 is pulled out the first inserting hole 200 of the insulating housing 2 of the audio socket connector 100, then the first curved arm 4004 of the first signal terminal 400, the second curved arm 4024 of the second signal terminal 402, the third curved arm 4044 of the third signal terminal 404, the fourth curved arm 4064 of the fourth signal terminal 406 and the fifth curved arm 4084 of the fifth signal terminal 408 can be respectively separated from the audio plug 9.

Meanwhile, the metal guiding piece 4242 of the insulating guider 424 is separated from the audio plug 9. Each connecting tab 4234 of the resilient connecting arm 4224 of the movable terminal 422 is brought to connect to the corresponding connecting arm 4204 of the fixed terminal 420 for switching off the audio function by the elastic force of the resilient connecting arm 4224 of the movable terminal 422.

The structure and operation of the second terminal set 6 is similar to the first terminal set 4. The structure of the second inserting hole 202 is similar to the first inserting hole 200. The structure of the second groove set 206 is similar to the first groove set 204.

As described above, the rear housing 22 can retain the first terminal set 4 and the second terminal set 6 inserted in the front housing 20 from the rear surface thereof and improve the strength of the audio socket connector 100. The insulating guider 424 of the switch module 42 is electronically insulated from the fixed terminal 420 and the movable terminal 422 for preventing the audio function from influence if the audio plug 900 is inserted into the audio socket connector 100.

Due to the edge of the metal guiding piece 4242 abuts against the audio plug 900, and the metal guiding piece 4242 and the resilient connecting arm 4224 are molded with the insulating block 4240, the strength of the terminals set of the audio socket connector 100 will be improved. Since, the audio socket connector 100 has strong structure and high reliability.

Furthermore, the present invention is not limited to the embodiments described above; diverse additions, alterations and the like may be made within the scope of the present invention by a person skilled in the art. For example, respective embodiments may be appropriately combined.

What is claimed is:

1. An audio socket connector, comprising:

an insulating housing;

an inserting hole;

at least one terminal set received in the insulating housing; and a switch module received in the insulating housing, comprising: a fixed terminal; a movable terminal; and an insulating guider connected to the moveable terminal, the insulating guider electronically insulated from the moveable terminal and the fixed terminal; wherein the insulating guider comprises an insulating block connected to the moveable terminal;

the fixed terminal comprises: a first retained body retained in the insulating housing; and a pair of connecting arms respectively extended from the first retained body and extended toward the moveable terminal and spaced from each other; and the movable terminal comprises: a second retained body retained in the insulating housing;

a resilient arm defining:

a first end portion connected to the second retained body;

a second end portion molded with the insulating block and positioned between the connecting arms of the fixed terminal; and a pair of connecting tabs respectively extended from opposite sides of the second end portion and protruded from the insulating block for respectively connecting to the connecting arms of the fixed terminal.

2. The audio socket connector as claimed in claim 1, wherein a metal guiding piece is connected to the insulating block and electronically insulated from the moveable terminal and the fixed terminal.

3. The audio socket connector as claimed in claim 1, wherein the fixed terminal comprises:

a pair of first retained arms extended from the first retained body;

a first soldering leg extended from the first retained body; and the movable terminal comprises:

a pair of second retained arms extended from the second retained body;

a second soldering leg;

the connecting arms are respectively extended from opposite end portions of one side of the first retained body, the first retained arms are respectively extended from opposite end portion of the other side of the first retained body; and the resilient arm is extended from the second retained body and between the second retained arms.

4. The audio socket connector as claimed in claim 3, wherein the first retained arms and the second retained arms are respectively formed as an L-shape.

5. The audio socket connector as claimed in claim 4, wherein the second soldering leg is extended from one of the second retained arms.

6. The audio socket connector as claimed in claim 1, wherein the terminal set comprises:

a signal terminal with a curved arm; and a retaining terminal with a curved arm opposite to the curved arm of the signal terminal.

7. The audio socket connector as claimed in claim 6, wherein the insulating housing comprises:

a front housing receiving the terminal set and the switch module;

a rear housing engaged with the front housing;

the inserting hole is penetrated a front surface and a rear surface of the front housing and extended into the rear housing.

8. The audio socket connector as claimed in claim 7, wherein the rear housing comprises a restricting surface formed in the inserting hole.

9. An audio socket connector for being inserted by an audio plug, comprising:

an insulating housing; an inserting hole; a plurality of signal terminals received in the insulating housing; and a switch module received in the insulating housing, comprising:

a fixed terminal;

a movable terminal; and an insulating guider connected to the moveable terminal and extended into the inserting hole; wherein the audio plug is inserted into the inserting hole and connected to the insulating guider, the audio plug is electronically insulated from the movable terminal via the insulating guider; wherein the insulating guider comprises an insulating block connected to the moveable terminal;

the fixed terminal comprises:

a first retained body retained in the insulating housing; and a pair of connecting arms respectively extended from the first retained body and extended toward the moveable terminal; and the movable terminal comprises:

a second retained body retained in the insulating housing;

a resilient arm defining:

a first end portion connected to the second retained body;

a second end portion molded with the insulating block and positioned between the connecting arms of the fixed terminal; and a pair of connecting tabs respectively extended from opposite sides of the second end portion and protruded from the insulating block for respectively connecting to the connecting arms of the fixed terminal.

10. The audio socket connector as claimed in claim 9, wherein a metal guiding piece is connected to the insulating block and electronically insulated from the movable terminal, the metal guiding piece comprises an edge extended into the inserting hole and connected to the audio plug.

11. The audio socket connector as claimed in claim 9, wherein the fixed terminal comprises:

a pair of first retained arms extended from the first retained body;

a first soldering leg extended from the first retained body;

the movable terminal comprises:

a pair of second retained arms extended from the second retained body;

a second soldering leg;

the connecting arms are respectively extended from opposite end portions of one side of the first retained body, the first retained arms are respectively extended from opposite end portion of the other side of the first retained body;

the resilient arm is extended from the second retained body and between the second retained arms.

12. The audio socket connector as claimed in claim 11, wherein the first retained arms and the second retained arms are respectively formed as an L-shape.

13. The audio socket connector as claimed in claim 12, wherein the second soldering leg is extended from one of the second retained arms.

14. The audio socket connector as claimed in claim 13, wherein the insulating housing comprises:

a front housing receiving the terminal set and the switch module;

a rear housing engaged with the front housing;

the inserting hole is penetrated a front surface and a rear surface of the front housing and extended into the rear housing.

15. The audio socket connector as claimed in claim 14, wherein the rear housing comprises a restricting surface formed in the inserting hole.

16. A switch module for using in an audio socket connector mating with a metal product, comprising:

a fixed terminal;

a movable terminal; and an insulating guider connected to the moveable terminal; wherein the metal product connects to and pushes the insulating guider for driving the movable terminal to move, the metal product is insulated from the movable terminal via the insulating guider; wherein the insulating guider comprises an insulating block connected to the moveable terminal;

the fixed terminal comprises:

a first body; and a pair of connecting arms respectively extended from the first body and extended toward the moveable terminal; and the movable terminal comprises: a second body;

a resilient arm defining:

a first end portion connected to the second body;

a second end portion molded with the insulating block positioned between the connecting arms of the fixed terminal; and a pair of connecting tabs respectively extended from opposite sides of the second end portion and protruded from the insulating block for respectively connecting to the connecting arms of the fixed terminal.

17. The switch module as claimed in claim 16, wherein a metal guiding piece is connected to the insulating block and electronically insulated from the movable terminal, the metal guiding piece comprises an edge connected to the metal product.

* * * * *